US006419462B1

(12) United States Patent
Horie et al.

(10) Patent No.: US 6,419,462 B1
(45) Date of Patent: Jul. 16, 2002

(54) POSITIVE DISPLACEMENT TYPE LIQUID-DELIVERY APPARATUS

(75) Inventors: Kuniaki Horie; Yukio Fukunaga; Akihisa Hongo; Kiwamu Tsukamoto; Kenji Kamoda; Hirotake Yamagishi; Shinya Uemura, all of Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/627,779

(22) Filed: Jul. 28, 2000

Related U.S. Application Data

(63) Continuation-in-part of application No. 09/028,312, filed on Feb. 24, 1998.

(30) Foreign Application Priority Data

Feb. 24, 1997 (JP) ..... 9-55506
Dec. 2, 1999 (JP) ..... 11-343399

(51) Int. Cl.[7] ..... F04B 43/10
(52) U.S. Cl. ..... 417/394; 417/395
(58) Field of Search ..... 417/394, 395, 417/472, 412

(56) References Cited

U.S. PATENT DOCUMENTS

| | | | | |
|---|---|---|---|---|
| 4,551,076 | A | 11/1985 | BuBois | 417/395 |
| 4,604,037 | A | 8/1986 | Hoya | 417/394 |
| 4,725,207 | A | 2/1988 | Buchwald et al. | 417/412 |
| 4,818,706 | A | 4/1989 | Starr | 417/395 |
| 5,061,156 | A | 10/1991 | Kuehne et al. | 417/412 |
| 5,174,732 | A | 12/1992 | Hoya | 417/394 |
| 5,361,800 | A | 11/1994 | Ewing | |

FOREIGN PATENT DOCUMENTS

| | | |
|---|---|---|
| DE | 31 34 911 | 3/1983 |
| DE | 44 20 694 | 12/1995 |
| DE | 195 23 371 | 5/1996 |
| EP | 0 248 514 | 12/1987 |
| EP | 0 376 497 | 7/1990 |
| EP | 0 529 334 | 3/1993 |
| FR | 2 255 585 | 7/1975 |

*Primary Examiner*—John Kwon
(74) *Attorney, Agent, or Firm*—Wenderoth, Lind & Ponack, L.L.P.

(57) ABSTRACT

A positive displacement liquid-delivery apparatus includes a positive displacement pump 110 and a differential pressure control unit 142. The positive displacement pump 110 includes a liquid-delivery chamber 128 having a watertight housing 122 with one part formed of a flexible diaphragm 124, and a diaphragm driver 136 linked to the diaphragm 124 for deforming the same to discharge fluid from the liquid-delivery chamber 128. The differential pressure control unit 142 uniformly controls the differential pressure inside and outside the diaphragm 124 during the pumping process.

12 Claims, 11 Drawing Sheets

POSITIVE DISPLACEMENT TYPE LIQUID-DELIVERY APPARATUS

This is a continuation-in-part of application Ser. No. 09/028,312, filed Feb. 24, 1998.

BACKGROUND OF THE INVENTION

1. Field of the Invention

The present invention relates to a positive displacement type liquid-delivery apparatus that can be used to deliver a very small amount of liquid at a constant rate to various processing apparatuses such as a chemical vapor deposition apparatus.

2. Description of the Related Arts

Recently, in the semiconductor manufacturing industry, the integration of integrated circuits has been improved remarkably, and the research and development activities of DRAM are being intensively carried out in anticipation of gigabit order DRAMs which will replace current megabit order DRAMs. A capacitor element having a large capacity per unit area is needed to produce such DRAMs. As a dielectric thin-film material for producing elements having such a large capacity per unit area, a metallic oxide film material such as tantalum pentaoxide ($Ta_2O_5$) having a dielectric constant of approximately 20, or barium titanate ($BaTiO_3$) or strontium titanate ($SrTiO_3$) or barium strontium titanate having a dielectric constant of approximately 300 is considered to be a promising thin-film material.

To deposit such a metallic oxide film material on a substrate in a vapor phase, a gaseous mixture made by mixing one or more gas feed materials of organometallic compounds and an oxygen containing gas is ejected to a substrate heated to a certain temperature. Organometallic gaseous feed material is chosen based on the nature of the thin film to be produced. For example, a metallic oxide film comprised by barium strontium titanate is produced by first converting Ba, Sr, Ti or their compounds into their dipivaloylmethane (DPM) compounds, and dissolving these compounds in an organic solvent such as tetrahydrofuran (THF) to produce respective liquid feed materials. After uniformly mixing these liquid feed materials in a required proportion to produce a master liquid feed, such master liquid feed is sent to a vaporizer to produce a gaseous feed for use in the chemical vapor deposition apparatus.

Such master liquid feed is extremely susceptible to degradation even in a sealed container, and therefore it is undesirable to have such a master liquid feed stagnate inside delivery piping. The master liquid feed is especially susceptible to producing precipitate particles, by being heated or being exposed to air, which tend to produce inferior quality films. Therefore, once the component liquids are mixed into a master liquid feed, it is necessary that the master liquid feed be maintained in a stable condition. It is also desirable that the master liquid feed be completely used up as quickly as practicable. Furthermore, it is desirable that the film deposition apparatus be capable of exercising a fine control of the flow rate of the master liquid feed over a wide range of flow rates from a very small flow rate to a large flow rate. Therefore, the liquid-delivering apparatus should be capable of providing a stringent control of the flow rates of the liquid feed.

As a positive displacement type liquid-delivering apparatus used in these applications, there has been known such an apparatus in which a mass flow controller (WFC) is provided in the piping connecting a feed liquid tank and a processing apparatus such as a vaporizer. The feed liquid tank is pressurized with gas or the like to deliver liquid, and a control valve on the MFC is adjusted to control a delivery rate of liquid. Positive displacement pumps incorporating pistons, diaphragms, and the like are also used.

In general, conventional apparatuses using a mass flow controller have a poor reproducibility of flow control near the lower limit of the allowable control range. Moreover, when the pressure in the processing apparatus increases, a pressure exceeding the pressure in the processing apparatus must be applied to the feed liquid tank side. Hence, a large amount of gas used for pressurizing is dissolved in the liquid in the feed liquid tank, and this dissolved gas is released downstream of the control valve of the mass flow controller or causes surge or pulsation in the flow of the liquid feed.

Although a positive displacement pump can overcome these drawbacks, a piston pump cannot be used because the sliding parts of the pump generate particles that contaminate the liquid. The positive displacement pumps employing bellows or diaphragms do not contaminate the liquid, but present the following problems.

It is conceivable to construct such a positive displacement pump in which a container is partitioned by a diaphragm into two chambers, i.e., a liquid delivery chamber and a working fluid chamber, and an incompressible liquid is used as a working fluid. With this construction, the diaphragm moves according to the amount of the working fluid supplied to the working fluid chamber for thereby discharging liquid from the container. Therefore, the precision in controlling the flow rate is more or less dependent on the precision of the external driving system. As a result, an external device is required for pumping the working fluid, and hence troublesome handling of the working fluid is necessary and the overall apparatus becomes large-sized.

If a driving device for driving the diaphragm is constructed mechanically, then these problems are eliminated and the overall apparatus becomes simple. However, it is very difficult to control the movement of the diaphragm so as to continuously deliver liquid at a constant rate if the processing conditions (pressure) in the secondary side (downstream side) of the container vary. Even if a flow meter is installed in the secondary side of the container for performing feedback control, it is not possible to obtain a better performance than that of the mass flow controller, because precision and reproducibility of the flow meter is the same level as the flow controller.

When the liquid-delivery is stopped, the pressure in the secondary side of the positive displacement pump slowly decreases due to a small leak in the check valve provided in the primary side (upstream side) of the processing apparatus (the part to which liquid is supplied). This may lead to a pressure drop when the liquid-delivery resumes, requiring time to stabilize the flow rate of liquid and potentially causing other problems. For example, if the pressure in the processing apparatus is below atmospheric pressure, the liquid feed may be vaporized because the pressure in the primary side of the check valve drops below the vapor pressure of the liquid feed.

Further, in the positive displacement pump, pressure variations occur in piping in the secondary side of the pump when the pumping operation begins, and hence the flow rate of liquid cannot be controlled until the liquid-delivery is stabilized. If a plurality of liquid feeds are required to be delivered at the same ratio, for example, these liquid feeds cannot be used until the liquid-delivery is stabilized.

SUMMARY OF THE INVENTION

In view of the foregoing, it is an object of the present invention to provide a positive displacement type liquid-delivery apparatus employing a positive displacement pump with a flexible diaphragm which can supply liquid at a constant rate with high precision and high reproducibility, shorten the time required to stabilize the liquid-delivery from the start of the pumping operation, and control the flow rate of liquid immediately after the pumping operation begins.

According to an aspect of the present invention, there is provided a positive displacement liquid-delivery apparatus comprising: a positive displacement pump comprising a housing having a liquid-delivery chamber divided by a flexible diaphragm and a diaphragm driving unit linked to the diaphragm to discharge fluid from the liquid-delivery chamber; and a differential pressure control unit for controlling the differential pressure between both sides of the diaphragm at a constant value during the pumping process.

Accordingly, the construction of the apparatus is simplified because the diaphragm is driven directly by the diaphragm driving unit. Further, by keeping the differential pressure between both sides of the diaphragm at a constant value, it is possible to keep the diaphragm at a constant amount of deformation, thus eliminating error caused by the diaphragm deformation. Hence, the diaphragm driving unit can control the amount of deformation in the diaphragm to perform precise flow rate control.

In a preferred aspect of the present invention, the differential pressure control unit comprises a differential pressure sensor for detecting the differential pressure between both sides of the diaphragm, and a control valve for controlling the flow rate of the liquid discharged from the liquid-delivery chamber on the basis of a signal from the differential pressure sensor.

Accordingly, it is possible to adjust the pressure in the liquid-delivery chamber indirectly by adjusting the control valve. If there is sufficiently low pressure variation in the space on the opposite side of the diaphragm from the liquid-delivery chamber, such as atmospheric pressure, the pressure sensor is required to be used only in the space on the side facing the liquid-delivery chamber.

In a preferred aspect of the present invention, a flow sensor is disposed on a discharge path and control is performed based on a signal from the flow sensor when the pressure in the liquid-delivery chamber during the pumping process exceeds a prescribed value or the absolute value of the rate of pressure variations exceeds a prescribed value.

With this construction, precise control can be preformed even with severe variations in the system conditions.

In a preferred aspect of the present invention, the liquid-delivery chamber is arranged so as to achieve the required discharge flow volume of the fluid in one stroke.

With this construction, the bellows operation is always stable and uniform for each process, thereby avoiding pressure and flow rate variations that occur, for example, when switching valves in alternate operations. Performing one pump operation using only a portion of one stroke can further increase the life of the bellows.

In a preferred aspect of the present invention, the gas is employed to pressurize the space on the opposite side of the diaphragm from the liquid-delivery chamber.

Generally speaking, the diaphragm itself has an allowable differential pressure between the sides of the bellows. When this differential pressure is small or the pressure required in the processing apparatus on the secondary side of the pump is larger than the allowable differential pressure, liquid-delivery cannot be performed if the pressure on the side of the diaphragm opposite from the liquid-delivery is atmospheric pressure. However, it is possible to keep the differential pressure low by pressurizing this side opposite the liquid-delivery chamber with a gas in order to maintain the differential pressure within the tolerable level for pumping operations.

Since the differential pressure of the diaphragm must be maintained at a constant value as described above in order to supply the fluid at a constant flow rate, the gas pressure P must also be constant. In the example described above, the volume V on the side of the diaphragm opposite the liquid-delivery chamber varies during pumping operations. Accordingly, the side of the diaphragm opposite the liquid-delivery chamber should be supplied with an amount of gas based on the liquid-delivery amount $\Delta V$, that is, $\Delta V \times P$.

The method of controlling the differential pressure between both sides of the diaphragm can be applied for using the pressure of the gas and the liquid, and controlling the pressure on the gas side. However, the injection and discharge of gas requires some time, resulting in control delays when pressure variations occur abruptly. Hence, variations in the differential pressure may occur more frequently, making it difficult to maintain a prescribed amount of liquid. Still, this method may be suitable for processes that have no severe pressure variations.

A leak sensor can be provided in the space opposite the liquid-delivery chamber for detecting fluid leaking caused by breakage in the diaphragm. With this arrangement, breakage in the diaphragm can be detected. If the side opposite the liquid-delivery chamber is also filled with liquid for driving the diaphragm, it is extremely difficult to detect breakage in the diaphragm. In the event that the diaphragm breaks, liquid for driving the diaphragm is mixed with the liquid to be pumped and the mixture is pumped together. Since the amount of liquid discharged from the apparatus does not vary, the breakage cannot be detected on a flow rate monitor.

In the present invention, however, breakage in the diaphragm can be detected by providing a relief discharge port, for example, on the gas side of the diaphragm and a relief sensor in the relief discharge port or on the secondary side. Further, it is possible to prevent gas from mixing with the pump side by always keeping the gas side at a lower pressure than the pump side. Hence, the present invention can avoid the problem of pumping liquid that mixes with driving liquid when the diaphragm breaks. Such problem is common to a conventional apparatus with fluid-driven diaphragms.

In a preferred aspect of the present invention, a plurality of positive displacement pumps are arranged in parallel and deliver different kinds of fluid to a single processing unit.

In a preferred aspect of the present invention, two positive displacement pumps deliver the same kind of fluid, and alternately deliver the fluid to a single processing unit in a continuous manner.

In a preferred aspect of the present invention, a housing having a liquid-delivery chamber is divided by a flexible diaphragm and a diaphragm driving unit linked to said diaphragm to discharge fluid from said liquid-delivery chamber. The diaphragm driving unit drives the diaphragm to maintain the flow rate of the liquid discharged from the liquid-delivery chamber at a constant rate based on the variation of the differential pressure between both sides of the diaphragm.

In a preferred aspect of the present invention, the liquid-delivery chamber is arranged so as to achieve the required discharge flow volume of the fluid in one stroke.

In a preferred aspect of the present invention, the gas is employed to pressurize the space on the opposite side of the diaphragm from the liquid-delivery chamber.

In a preferred aspect of the present invention, a plurality of positive displacement pumps are arranged in parallel and deliver different kinds of fluid to a single processing unit.

In a preferred aspect of the present invention, two positive displacement pumps deliver the same kind of fluid, and alternately deliver the fluid to a single processing unit in a continuous manner.

According to an aspect of the present invention, there is provided a positive displacement liquid-delivery apparatus comprising: a positive displacement pump comprising a housing having a liquid-delivery chamber divided by a flexible diaphragm and a diaphragm driving unit linked to the diaphragm to discharge fluid from the liquid-delivery chamber; a discharge path extending from the liquid-delivery chamber; a check valve disposed on the discharge path; and a pressure control unit for controlling the primary side pressure of the check valve so as not to drop below the vapor pressure of the fluid discharged from the liquid-delivery chamber during stoppage of the pumping process.

With this construction, it is possible to prevent a drop in pressure on the primary side of the check valve caused by a leak from the check valve and the generation of voids caused by vaporization.

In a preferred aspect of the present invention, the pressure control unit comprises a control valve disposed upstream of the check valve, and regulates the pressure in the liquid-delivery chamber during pump stoppage at the pressure required for pumping operation.

With this construction, if the pipe connecting the check valve and control valve is sufficiently short and formed of a highly rigid material and there is almost no volume expansion in this section of pipe when its internal pressure rises at the beginning of the pumping process, it is possible to set the pressure in the secondary side of the check valve to the normal pressure for pumping immediately after pumping begins in order to pump a prescribed flow rate without any time lag.

In a preferred aspect of the present invention, the pressure control unit comprises a control valve disposed upstream of the check valve, and regulates the pressure in the liquid-delivery chamber during pump stoppage at a pressure higher than the pressure required for pumping operation by an amount equivalent to the estimated amount caused by the volume expansion of the piping between the check valve and control valve.

With this construction, if this section of pipe is a flexible pipe with low rigidity and there is volume expansion in the pipe when the pressure rises at the beginning of the pumping process, it is possible to set the pressure in the secondary side of the check valve to the normal pressure for pumping immediately after pumping begins in order to pump a prescribed flow rate without any time lag.

In a preferred aspect of the present invention, the liquid-delivery chamber is arranged so as to achieve the required discharge flow volume of the fluid in one stroke.

In a preferred aspect of the present invention, the gas is employed to pressurize the space on the opposite side of the diaphragm from the liquid-delivery chamber.

In a preferred aspect of the present invention, a plurality of positive displacement pumps are arranged in parallel and deliver different kinds of fluid to a single processing unit.

With this construction, the apparatus can individually control a different flow rate of fluid discharged from each positive displacement pump from the moment the pumping process begins, thereby always pumping the same proportion of fluids to the single process device.

In a preferred aspect of the present invention, two positive displacement pumps deliver the same kind of fluid, and alternately deliver the fluid to a single processing unit in a continuous manner.

With this construction, it is possible to operate both pumps alternately such that the first pump gradually pumps a larger flow rate after the start of operations and the second pump gradually pumps a decreasing amount in order that the overall flow rate does not change. Accordingly, the same liquid can be supplied continuously to the single process device without variation in flow.

According to an aspect of the present invention, there is provided a deposition apparatus comprising: a vaporizer for vaporizing a fluid feed supplied from the positive displacement liquid-delivery apparatus; and a deposition chamber in which thin films are deposited using the feed gas supplied from the vaporizer.

The above and other objects, features, and advantages of the present invention will become apparent from the following description when taken in conjunction with the accompanying drawings which illustrate preferred embodiments of the present invention by way of example.

DESCRIPTION OF THE PREFERRED EMBODIMENTS

Figure 1:
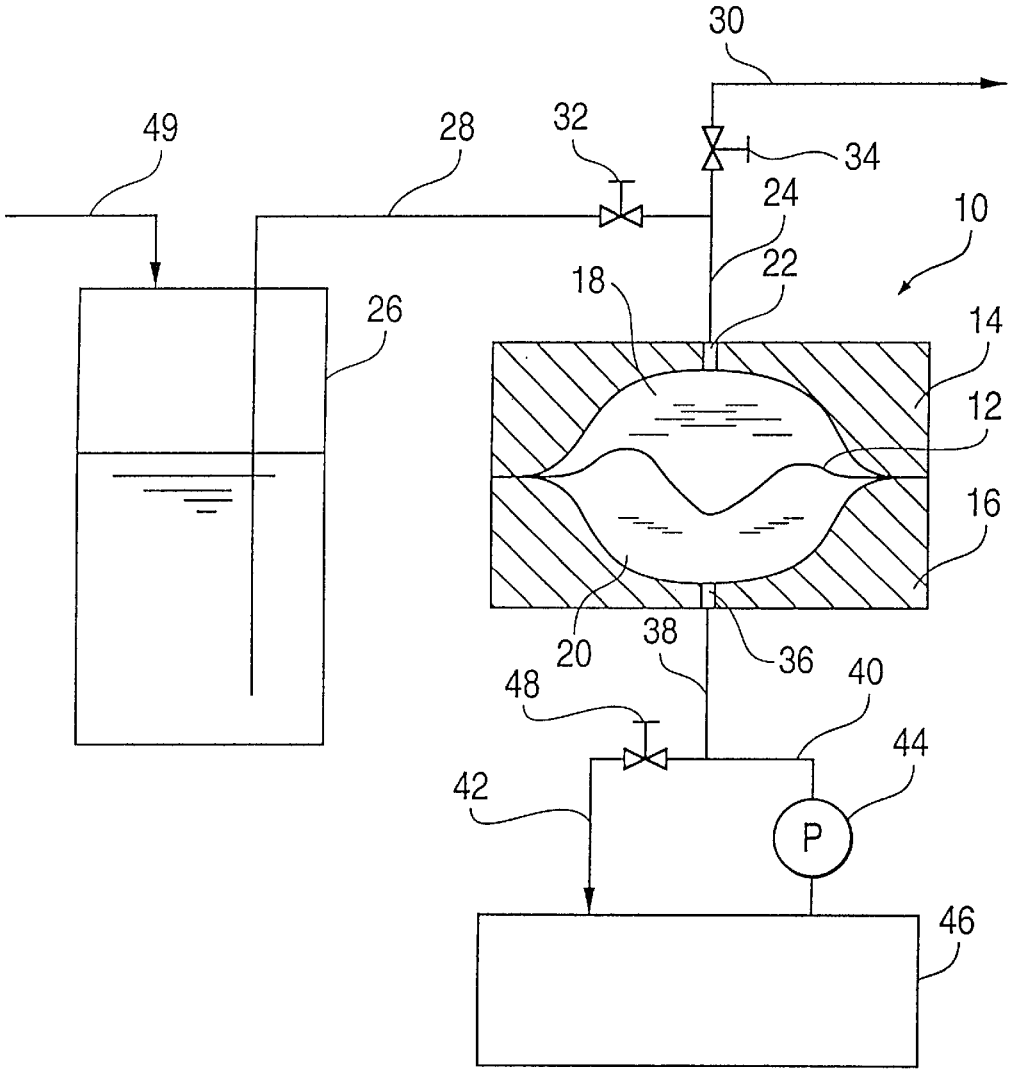
FIG. 1 is a schematic cross-sectional view showing a positive displacement pump according to a first embodiment of the present invention.

Preferred embodiments of a positive displacement pump will be described with reference to FIGS. 1 through 3. The positive displacement pump is designed to deliver a liquid feed material to a vaporizer to produce a gaseous feed for use in a chemical vapor deposition apparatus, for example.

The positive displacement pump comprises a housing structure (casing structure) 10 having a roughly flat interior space and a dividing membrane 12 (deformable wall) for separating the interior space into an upper section and a lower section. The housing structure 10 comprises an upper housing or housing member 14 (fixed wall), a lower housing or housing member 16, and the dividing membrane 12 attached therebetween by a suitable method so as to produce two liquid tight compartments in the interior. More specifically, the space defined by the upper housing 14 and the membrane 12 constitutes an object liquid feed space 18 for containing an object liquid to be delivered (in this case, a liquid feed), and the space defined by the lower housing 16 and the membrane 12 constitutes a working fluid space 20 for containing an incompressible working fluid.

The upper housing 14 has a liquid feed flow hole 22 connected to a feed distribution pipe 24 for passage of the liquid feed. The feed distribution pipe 24 is branched into an inflow pipe 28 connected to a liquid feed tank 26 and a delivery pipe 30 connected to a vaporizer (not shown), the pipes 28 and 30 having respective shut-off valves 32, 34. On the other hand, the lower housing 16 has a working fluid flow hole 36 connected to a working fluid pipe 38.

The working fluid pipe 38 is branched into a pressurized fluid pipe 40, and a return pipe 42 having a shut-off valve 48. The pressurized fluid pipe 40 is connected to a discharge port of a constant flow pump 44, and an input opening of the constant flow pump 44 is connected to a working fluid tank 46. It should be noted that, if the liquid feed exhibits a tendency to infiltrate through the membrane, the working fluid should be the same liquid as the solvent used to prepare the liquid feed. If there is no danger of infiltration, a liquid most suitable as a working fluid, such as water or silicone oil, may be chosen.

The membrane 12 may be made of a polymeric resin material having suitable properties, for example, synthetic rubber or flexible Teflon group materials, which are compatible with the liquid media being delivered. Standards for selection should include strength and elasticity properties, as well as chemical compatibility with the liquid feed and the working fluid. As illustrated in FIG. 1, the interior space of the housing structure 10 is vertically symmetrical with respect to a plane clamping the membrane 12, and is extended in a horizontal direction. That is, the interior space is shaped to be compatible with the contour of the deforming membrane 12.

The operation of the positive displacement pump, having the construction described above, will be described. A first step is to fill the liquid feed space 18 with the liquid feed. In this case, the constant flow pump 44 is stopped, the shut-off valve 48 in the return pipe 42 in the working fluid system is opened, the shut-off valve 32 in the inflow pipe 28 is opened, and the shut-off valve 34 in the delivery pipe 30 is closed. A pressurizing gas (e.g., Helium) is supplied from a pressure pipe 49 to the liquid feed tank 26 to deliver the liquid feed through the liquid feed flow hole 22 into the liquid feed space 18 in the upper housing 14.

The working fluid space 20 is compressed by the action of the pressurizing gas, and the working fluid in the working fluid space 20 is pushed back to the working fluid tank 46 through the return pipe 42. This filling step is normally performed until the membrane 12 reaches the bottom surface of the working fluid space 20. The pressure exerted by the pressurizing gas is extremely low and lasts only briefly during this liquid feed charging step such that there is little chance for the pressurizing gas to penetrate into the liquid feed to cause processing problems in the subsequent steps.

Next step is concerned with delivering a small quantity of liquid feed contained within the liquid feed space 18 to the vaporizer at the downstream side. To perform this step, the shut-off valve 48 of the return pipe 42 in the working fluid system is closed, the shut-off valve 32 of the inflow pipe 28 in the feed distribution system is closed, the shut-off valve 34 of the delivery pipe 30 is opened, and the constant flow pump 44 is operated. This causes the working fluid to flow through the working fluid flow hole 36 formed in the lower housing 16 into the working fluid space 20. The working fluid pushes the membrane 12 upward so as to deliver a required volume of the liquid feed through the delivery pipe 30 to the vaporizer.

In this process of liquid delivery, the discharge volume of the liquid feed is identical to the volume of the working fluid supplied to the working fluid space 20. In other words, the flow volume of the liquid feed is identical to the discharge volume of the constant flow pump 44. Therefore, by using a constant flow pump capable of discharging a small quantity of working fluid precisely, it is possible to precisely control the delivery of a required small volume of the liquid feed. Also, the action of the membrane 12 reduces pulsation in the flow pattern to provide a smooth delivery of the liquid feed.

During the initial stage of the feed delivery process, the membrane 12 becomes thinner because of elastic stretching thereof, but when the pressure is stabilized, thinning does not cause deviations in the delivered volume. Normally, the liquid feed received during the initial stage of delivery is discarded and is not used for film deposition so as to avoid quantity control problems of initial liquid delivery. Also, the volume of the liquid feed space 18 can be enlarged depending on the liquid feed requirement so that one charging of the liquid feed space 18 with the liquid feed is sufficient for a long production process.

In this type of liquid delivery apparatus, particles are not generated at sliding sections, because the liquid feed is not exposed to such sliding parts, so that a clean liquid feed can be delivered to the vaporizer at all times. Also, because sliding parts are not used, there is not any chance of degrading the liquid feed by exposure to air during repair or maintenance of sliding parts. Also, because the liquid delivery process is carried out by the movement of the membrane 12, there is almost no mixing of gases in the liquid feed compared with the case of direct gas pressurization on the liquid.

Also, in this embodiment, the shape of the interior contour of the housing structure 10 is chosen to match a swollen shape of the membrane 12, and the service life of the membrane 12 is prolonged by preventing localized deformation. Furthermore, there is minimal degradation of the liquid feed, because there is no dead zone in the liquid movement, since the pumping section is shaped to be relatively flatter (rather than deeper) to prevent stagnation.

Also, in this embodiment, the radius of the housing structure 10 is larger than its height to make its overall shape relatively flat, so that a small deformation of membrane 12 would be effective in moving the liquid, compared with the case of a vertically elongated shape of the pumping section. However, with a flat shape, it is necessary to provide a thicker housing structure 10 to prevent the housing structure 10 from deforming due to the pressure. When the housing structure 10 itself is deformed due to the pressure, precise control of liquid flow rates could be affected. If the membrane 12 could be made of a stiffer material to provide sufficient service life, it is preferable to make the diameter smaller and the height greater to provide a proper volume capacity of the housing structure 10.

Figure 2:
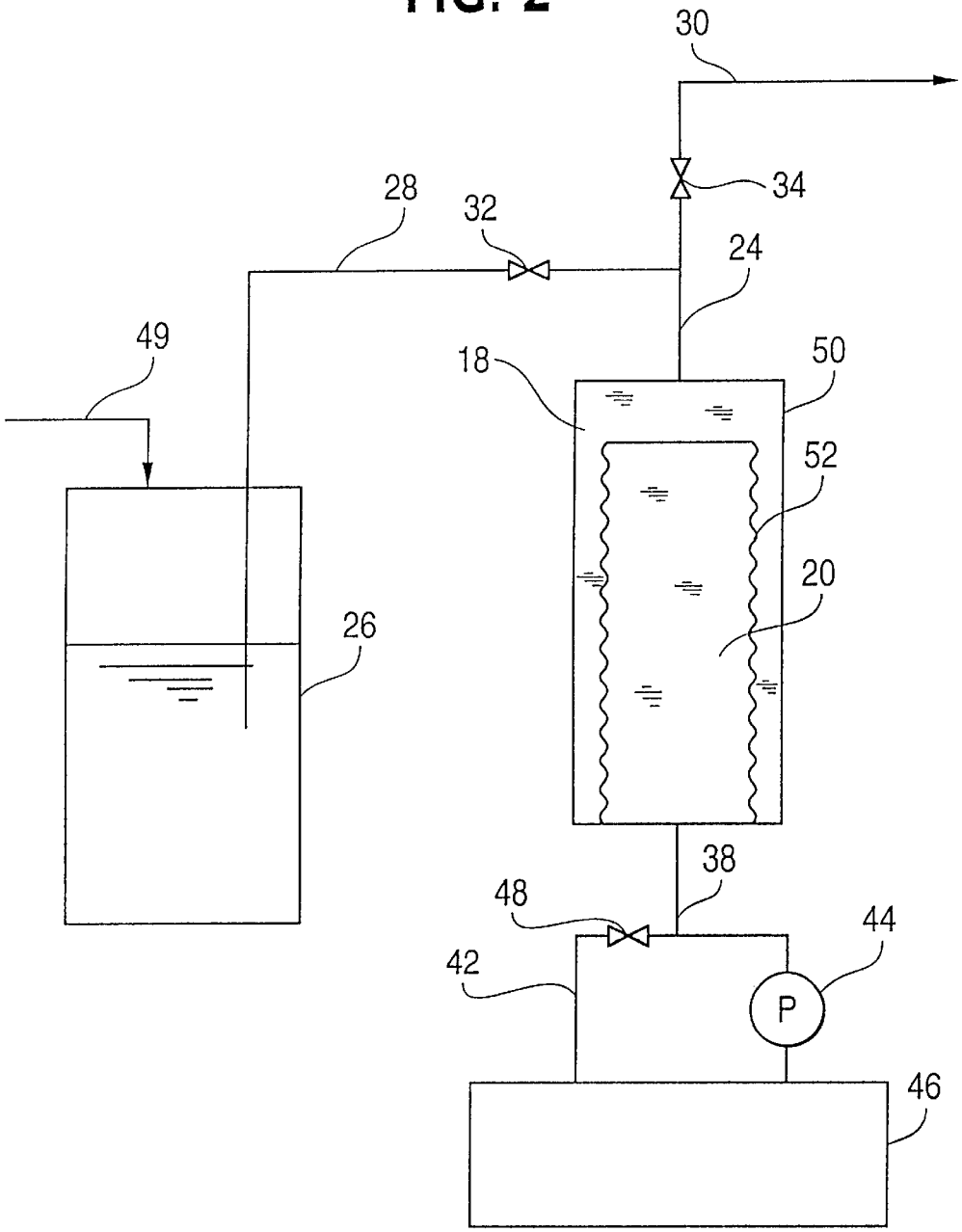
FIG. 2 is a schematic cross-sectional view showing a positive displacement pump according to a second embodiment of the present invention.

FIG. 2 shows a second embodiment of the positive displacement pump. Those parts which are the same as those in the previous embodiment are referred to by the same reference numerals. In this embodiment, a metallic bellows 52 replaces the membrane 12 of the first embodiment. The housing 50 is roughly cylindrical in shape and includes the coaxial inner bellows 52, having a closed top, whose bottom section is attached to the bottom section of the housing 50. The external space between the bellows 52 and the housing 50 constitutes the liquid feed space 18, and the interior space of the bellows 52 constitutes the working fluid space 20, with the spaces 18 and 20 having their respective piping. The material for making bellows 52 should be non-reactive to both the liquid feed and the working fluid.

The operation of the liquid delivery apparatus of this embodiment is basically the same as that of the first embodiment, and an explanation thereof will be omitted. It suffices to mention that, because the deformable wall is made of a metallic material, it is much more durable and service life is longer than a membrane made of a resin material.

Figure 3:
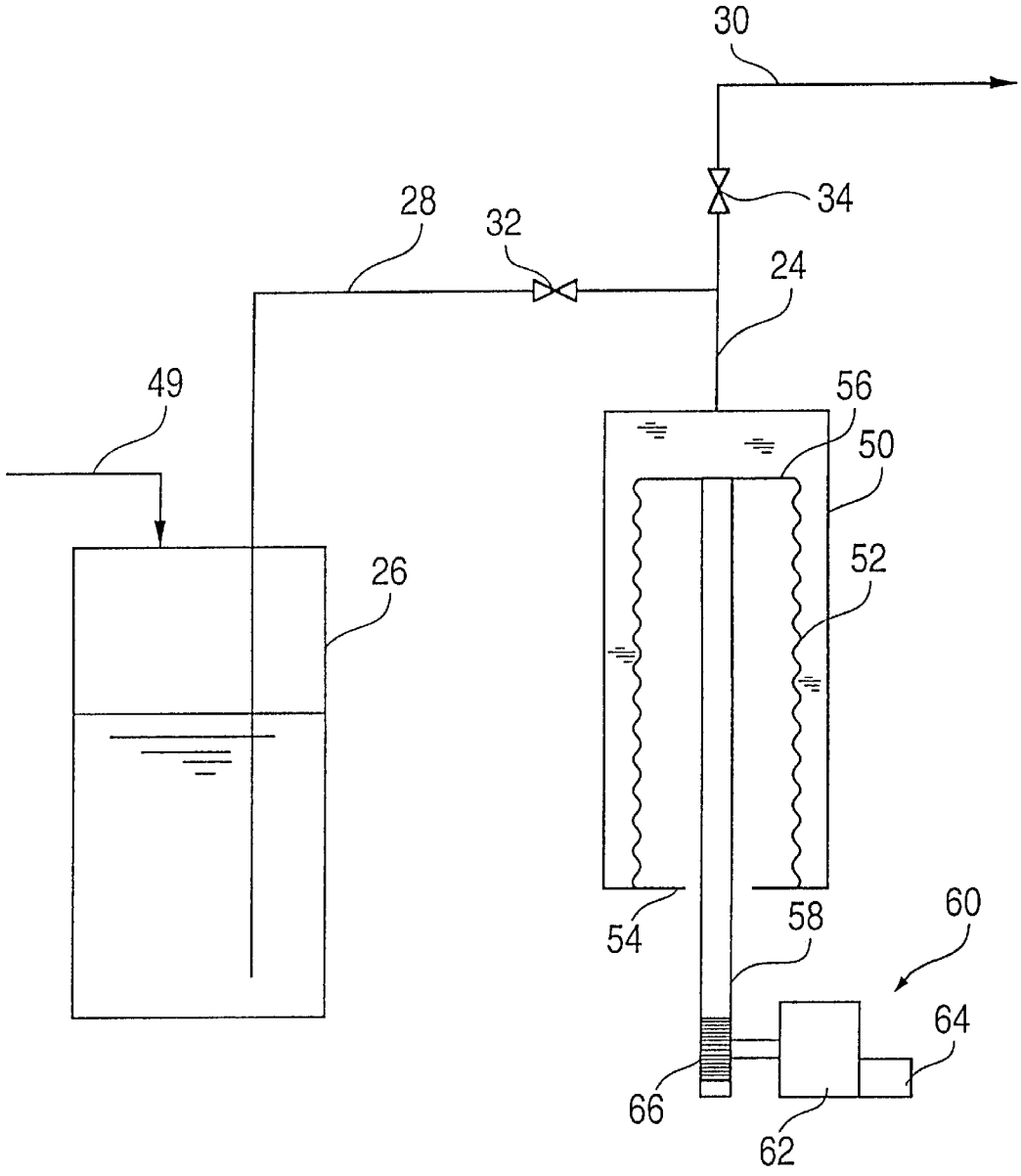
FIG. 3 is a schematic cross-sectional view showing a positive displacement pump according to a third embodiment of the present invention.

FIG. 3 shows still another embodiment, in which the bellows 52 is operated by a driving device. That is, the bottom section of the housing 50 has an opening 54 to eliminate the space corresponding to the working fluid space 20 in the previous embodiments. Instead of the working fluid, a push rod 58 extends through the opening 54, and a tip end of the push rod 58 is fixed to a ceiling 56 of the bellows 52. The proximal end of the push rod 58 is attached to an elevator device 60 for raising and lowering the push rod 58. The elevator device 60 comprises a motor 64 having a speed reducer 62 with a large speed reduction ratio and a gear mechanism 66 for converting rotation to linear movement so as to provide finely controlled up and down movements to the push rod 58. The operation of this apparatus is basically the same as that of the previous embodiments, and explanation thereof is omitted.

A positive displacement liquid-delivery apparatus according to preferred embodiments of the present invention will be described with reference to FIGS. 4 through 15. The positive displacement liquid-delivery apparatus incorporates a positive displacement pump shown in FIG. 3.

Figure 4:
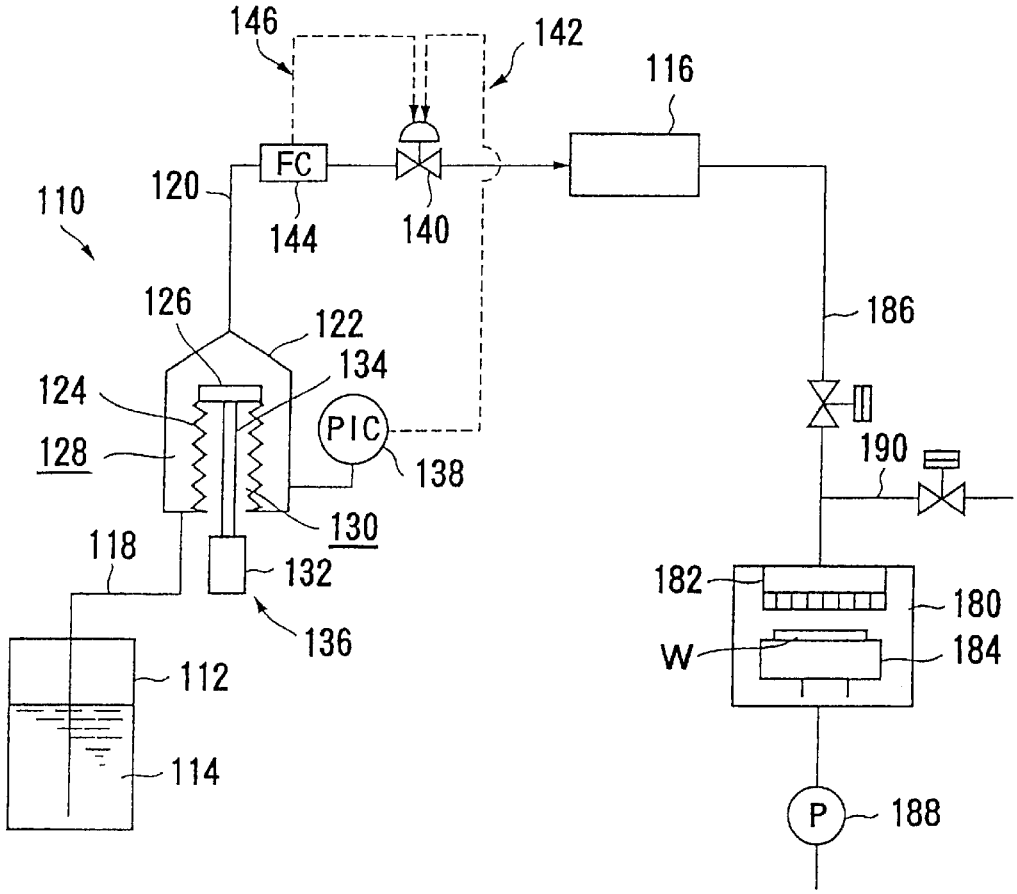
FIG. 4 is a schematic view showing a positive displacement type liquid-delivery apparatus according to a first embodiment of the present invention.
Figure 5:
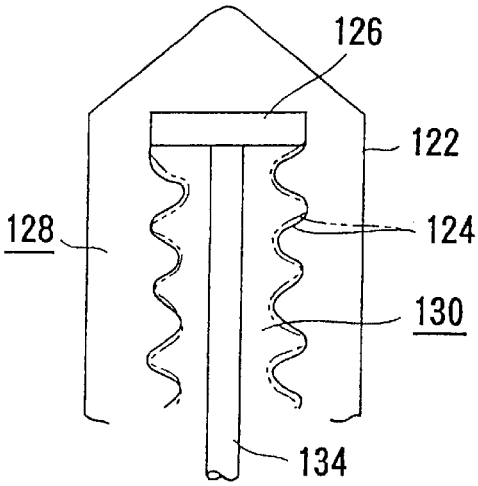
FIG. 5 is an enlarged view showing part of the positive displacement type liquid-delivery apparatus of FIG. 4.

FIGS. 4 and 5 show a positive displacement liquid-delivery apparatus according to a first embodiment of the present invention. In this positive displacement liquid-delivery apparatus, a liquid feed tank 112 accommodates a liquid 114, such as a liquid feed. A positive displacement pump 110 supplies the liquid 114 from the feed liquid tank 112 to a processing apparatus 116 at a prescribed amount. In this example, the processing apparatus 116 is a vaporizer that supplies deposition gas via a gas supply line 186 to a CVD reaction chamber 180. A gas injection head 182 in the reaction chamber 180 ejects the supplied deposition gas toward a semiconductor wafer W mounted on a base 184. The system shown in FIG. 4 also includes an exhaust pump 188 and a vent line 190 for venting the deposition gas.

The positive displacement pump 110 includes a housing 122 that is approximately cylindrical in shape. One end of the housing 122 is connected to an inlet pipe 118 extending from the feed liquid tank 112, while the other end is connected to an outlet pipe 120 connected to the processing apparatus 116. An opening is formed in the center of the bottom plate of the housing 122. A bellows 124 (diaphragm) is attached to the inner edge of this opening, and extends inwardly and concentrically with the housing 122. The other end of the bellows 124 is hermetically closed by a retaining plate 126. This construction of the housing 122 and bellows 124 forms a liquid-delivery chamber 128 capable of retaining liquid hermetically and varying its capacity. A working space 130 which is open to the air is also formed in the inner side of the bellows 124.

A diaphragm driving device 136 is provided in the working space 130. The diaphragm driving device 136 includes a drive unit 132 having a drive source such as a motor (not shown), and a rod 134 that moves up and down by actuation of the drive unit 132. The retaining plate 126 is connected to the top end of the rod 134. The drive unit 132 is provided with a conversion mechanism (not shown) for converting rotational movement by the drive source into linear movement with a feed screw mechanism or the like. When the drive unit 132 is operated, the bellows 124 extends and retracts in the axial direction, thereby changing the capacity of the liquid-delivery chamber 128 to supply a predetermined amount of liquid 114 to the processing apparatus 116.

A pressure gauge 138 is provided on the housing 122 for measuring the pressure inside the liquid-delivery chamber 128. A control valve 140 capable of controlling the degree to which it is opened is provided in the outlet pipe 120. A signal from the pressure gauge 138 is inputted into the control valve 140. The opening amount of the control valve 140 is adjusted based on the signal from the pressure gauge 138 to maintain the pressure P in the liquid-delivery chamber 128 at a constant value that is slightly higher than the pressure $P_0$ in the working space 130 (atmospheric pressure in this example). The control valve 140 and the pressure gauge 138 constitute a differential pressure control unit 142.

A flow meter 144 is also provided at the upstream side of the control valve 140 in the outlet pipe 120 for measuring the flow rate of liquid flowing in the outlet pipe 120. A signal from the flow meter 144 is also inputted into the control valve 140. Hence, the flow meter 144 and the control valve 140 constitute a flow control unit 146 for controlling the flow rate of liquid supplied to the processing apparatus 116 through the outlet pipe 120.

With this construction, the positive displacement liquid-delivery apparatus can switch selectively between control by the differential pressure control unit 142 and control by the flow control unit 146. Normally, the differential pressure control unit 142 controls operation, and the control valve 140 is controlled on the basis of signal from the pressure gauge 138 to maintain the differential pressure at a constant value as described above (normal mode). With this control, the discharge flow rate can be accurately and stably maintained.

This process will be described with reference to FIG. 5. If the bellows 124 is deformed at a constant rate, then the discharge flow rate can be expressed by a function dependent only on the stroke of the diaphragm driving device 136.

If a certain flow rate of liquid is being required, then changes in the stroke can be controlled so as to correspond to such flow rate.

However, because the bellows 124 is flexible by nature, the bellows 124 is deformed locally by a differential pressure ΔP between the pressure P in the liquid-delivery chamber 128 and the pressure $P_0$ in the working space 130 ($\Delta P=P-P_0$), in addition to the deformation caused by tensile force from the retaining plate 126. The solid lines describing the bellows 124 in FIG. 5 represent the bellows 124 in a state of equilibrium. If the pressure P in the liquid-delivery chamber 128 increases, and thus the differential pressure ΔP increases, then the bellows 124 may deform as shown by the chain double-dashed lines in FIG. 5. Hence, even if the position of the retaining plate 126 does not change, the change in the differential pressure ΔP will cause the capacity of the liquid-delivery chamber 128 to change.

By maintaining the differential pressure ΔP at a constant value while operating the bellows 124, it is possible to achieve a stable flow rate control, because variations or pulsations in the flow caused by random deformation of the bellows 124 are suppressed. Accordingly, the position of the retaining plate 126 will directly correspond to the capacity of the liquid-delivery chamber 128. Therefore, it is possible to accurately control the discharge flow rate, which is dependent only on the stroke of the diaphragm driving device 136.

In some cases, it is not possible to adjust the flow rate of liquid by simply monitoring the differential pressure with the pressure gauge and controlling the stroke on the basis of the differential pressure. In the pressure gauge that detects pressure by sensing the amount of deformation in an internal diaphragm or the like, when pressure variations are detected, the bellows has already deformed and a change in flow rate has already occurred. In the present embodiment, therefore, when the pressure inside the liquid-delivery chamber 128 exceeds a predetermined value, or the absolute value of the rate of pressure change exceeds a predetermined value, it is determined that the system is in a fluctuation state. At this time, control is switched from monitoring the differential pressure with the pressure gauge 138 to monitoring the flow rate with the flow rate meter 144. This specific arrangement enables the apparatus to maintain a precise flow rate of liquid even under unstable conditions.

Figure 6:
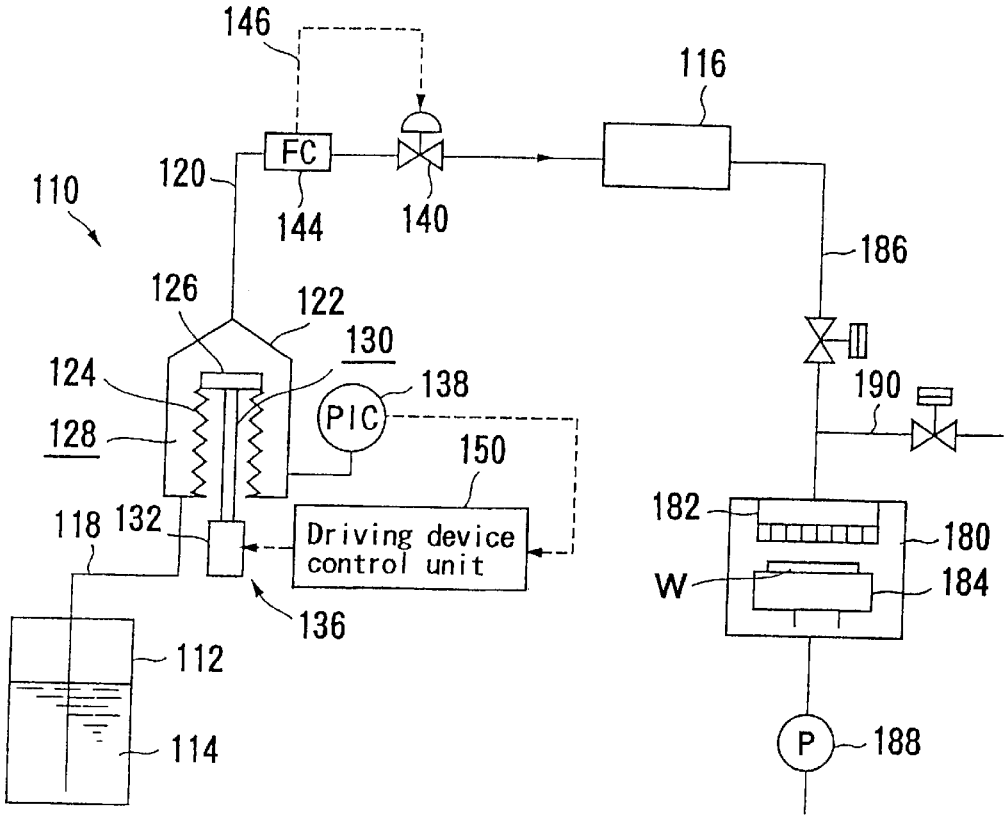
FIG. 6 is a schematic view showing a positive displacement liquid-delivery apparatus according to a second embodiment of the present invention.

FIG. 6 shows a positive displacement liquid-delivery apparatus according to a second embodiment of the present invention. The structure of the positive displacement liquid-delivery apparatus of the second embodiment differs from that of the first embodiment in that the differential pressure control unit 142 in the first embodiment is replaced with a driving device control unit 150 that receives a signal from the pressure gauge 138 to control the movement of the diaphragm driving device 136.

In this embodiment, the relationship between the pressure in the liquid-delivery chamber 128 and the amount of deformation of the bellows 124 is known in advance. The driving device control unit 150 moves the diaphragm driving device 136 to cancel deformation in the bellows 124 caused by pressure changes in the liquid-delivery chamber 128, thereby keeping a flow rate of liquid at a constant value.

The actual discharge flow rate Q discharged from the liquid-delivery chamber 128 can be defined by the following equation, where q is a set flow rate and V is the amount of deformation in the bellows 124 caused by the pressure P in the liquid-delivery chamber 128.

$$Q=q+(dV/dt)$$

Here, $$dV/dt=(dV/dP)\cdot(dP/dt)$$

Therefore, $$Q=q+(dV/dP)\cdot(dP/dt) \quad (1)$$

If the relationship (dV/dP) is known in advance, the driving device control unit 150 controls the diaphragm driving device 136 to achieve a set flow rate q when the initial set flow rate is $q_0$.

$$q=q_0-(dV/dP)\cdot(dP/dt)$$

As a result, it is possible to maintain Q at a constant value.

As an example, one case is where the amount of deformation V in the bellows 124 and the pressure P in the liquid-delivery chamber 128 have the following relationships, $$V=aP^b+d$$

Thus, $$dV/dP=abP^{b-1} \quad Q=q+abP^{b-1}\cdot(dP/dt)=q+abP^{b-1}\cdot(\Delta P/\Delta t) \quad (2)$$

Here, if the relationship $dV/dP=abP^{b-1}$ is known in advance, then a constant flow rate can be achieved by calculating the changes in pressure per unit time from the equation (2).

Figure 7:
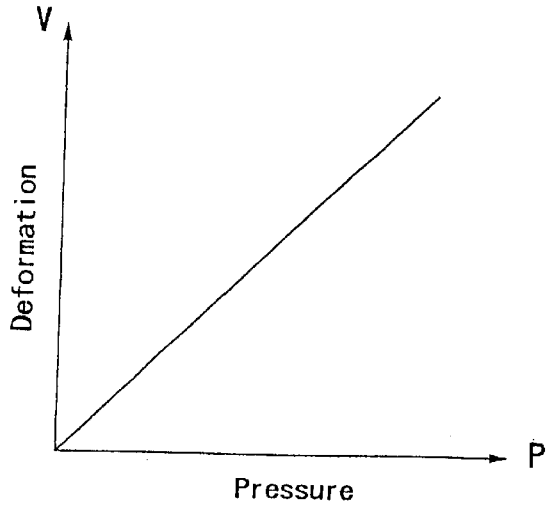
FIG. 7 is a graph showing the relationship between the pressure in the liquid delivery chamber and deformation of the bellows according to the second embodiment of the present invention.

As shown in FIG. 7, it can be seen that the dV/dP relationship is of a direct proportion. Therefore, the equation (2) can be simplified to:

$$Q=q+C(\Delta P/dt)$$

Performing control based on this equation is relatively easy.

Figure 8:
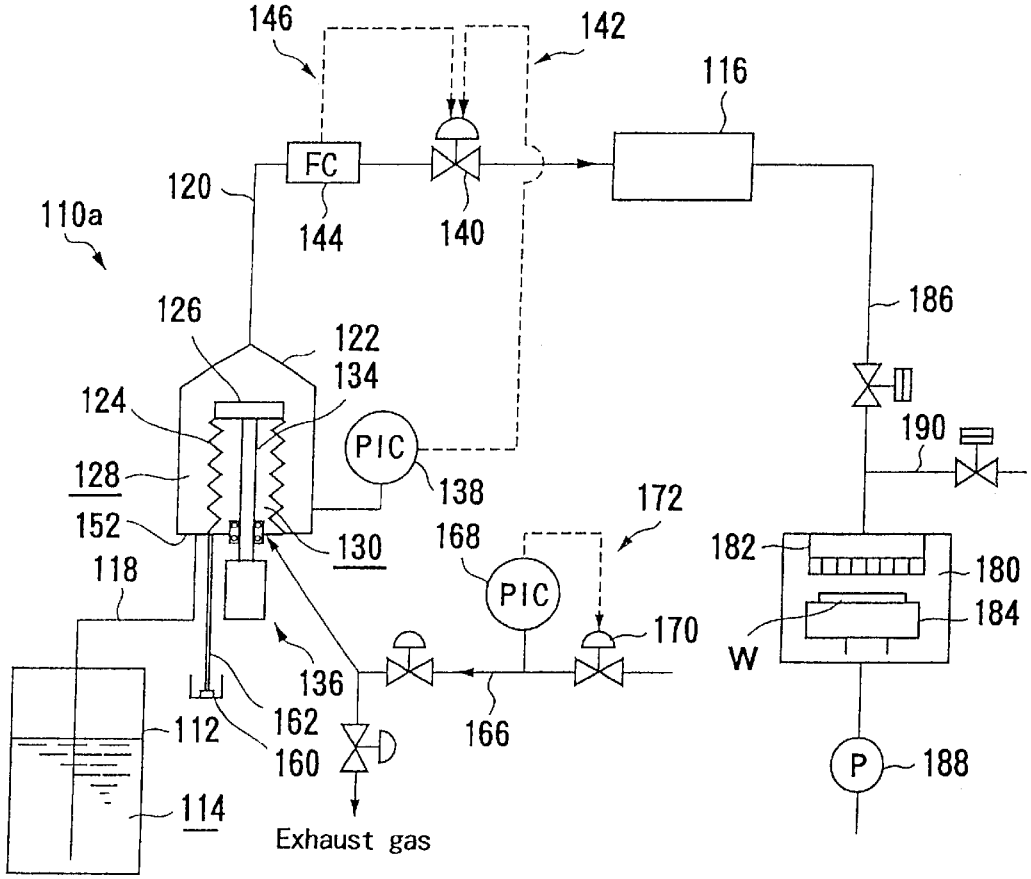
FIG. 8 is a schematic view showing a positive displacement type liquid-delivery apparatus according to a third embodiment of the present invention.
Figure 9:
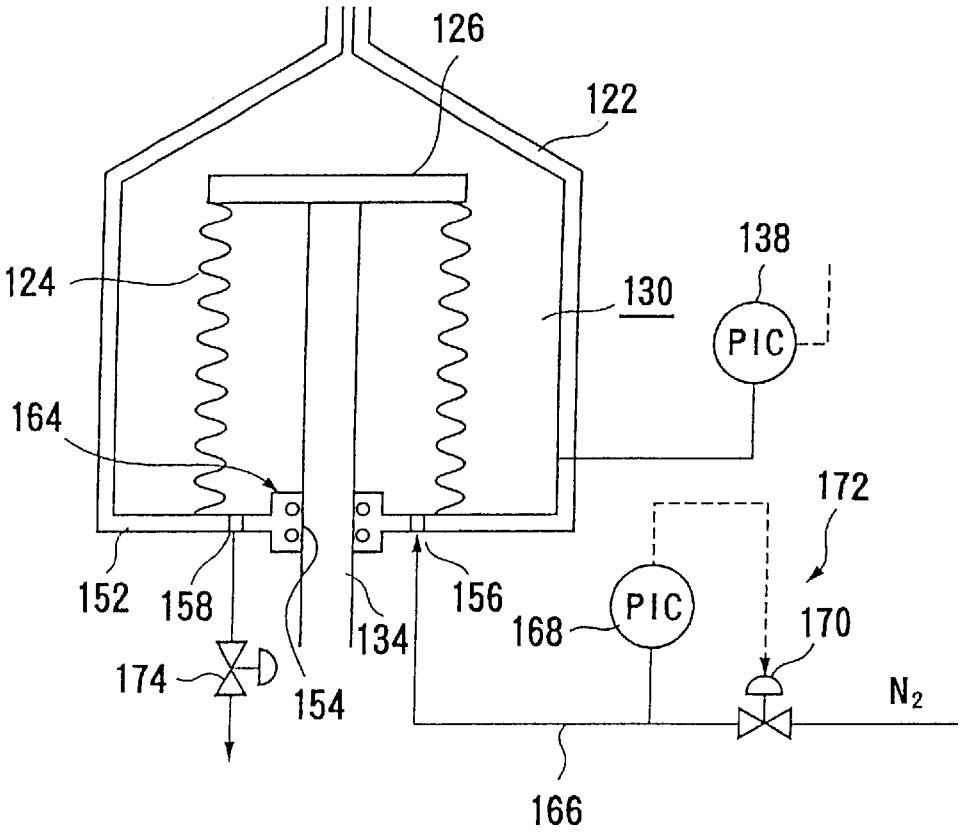
FIG. 9 is an enlarged cross-sectional view showing part of the positive displacement type liquid-delivery apparatus of FIG. 8.

FIGS. 8 and 9 show a positive displacement liquid-delivery apparatus according to a third embodiment of the present invention. In this embodiment, a positive displacement pump 110*a* has a closed system, wherein the working space 130 is not open to the atmosphere. That is, the bottom of the housing 122 is closed by a bottom plate 152. The bottom plate 152 has a through-hole 154 through which the rod 134 is inserted, an intake port 156 through which $N_2$ gas or another pressure regulating gas is introduced, and an exhaust port 158 for exhausting such gas in minute amounts. The bottom plate 152 is also provided with a leak fluid tube 162 for discharging liquid that has leaked into the working space 130 and for introducing the discharged liquid into a leak sensor 160. A seal mechanism 164 is provided in the through-hole 154 to seal the rod 134 hermetically.

The intake port 156 is connected to a pressure regulating gas source (not shown) by an intake tube 166. A pressure sensor 168 for detecting the pressure in the intake tube 166 (equivalent to the pressure in the working space) and a pressure control valve 170 for controlling the pressure in the intake tube 166 based on an output signal from the pressure sensor 168 are provided in the intake tube 166. A regulating valve 174 is provided in a line connected to the exhaust port 158 for adjusting a very small amount of exhaust. By setting the opening degree of the regulating valve 174 to a certain value and operating the pressure control valve 170 on the basis of the output signal from the pressure sensor 168, it is possible to cancel variations in pressure due to displacement of the bellows 124, and to maintain the pressure $P_1$ in the working space 130 at a constant value. The pressure sensor 168 and the pressure control valve 170 constitute a second differential pressure control unit 172.

Here, the flow rate from the pressure control valve 170 is defined as Q, the amount of gas supplied from the pressure control valve 170 when the bellows 124 is stopped is defined as $Q_1$, and the amount of gas discharged from the regulating valve 174 is defined as $Q_2$. Further, $\Delta V$ indicates the change in capacity caused by driving the bellows, and $\Delta Q=P_1\Delta V$ indicates the change in supplied gas followed by this capacity change $\Delta V$. Accordingly, $$Q=Q_2+\Delta Q$$

(when the bellows extends)

$$Q=Q_2-\Delta Q$$

(when the bellows retracts)

If Q>0 is not established, control becomes difficult, and hence the following conditions are established.

$$Q_2>\Delta Q$$

$$Q_2=Q_1$$

Hence, $Q_1$ and $Q_2$ are set so that the following is established.

$$Q_1>\Delta Q$$

By employing the controlling method described above, it is possible to maintain a flow rate of liquid at a desired value even when the delivery pressure of liquid increases due to clogging in the processing apparatus 116 at the downstream side, for example. It is also possible to perform a simple control process using only pressure regulating gas with this construction. However, as in the example of the first embodiment, this method would not be able to cope with abrupt changes in pressure.

In the event that the bellows 124 is damaged, and a hole or the like is formed in the embodiment described above, liquid leaking through the bellows 124 flows through the leak fluid tube 162 and reaches the leak sensor 160, where the leak will be detected. Accordingly, an appropriate action such as a warning alarm or an automatic pump shutdown procedure will be performed based on an output signal from this leak sensor 160 to prevent an accident from occurring.

Figure 10:
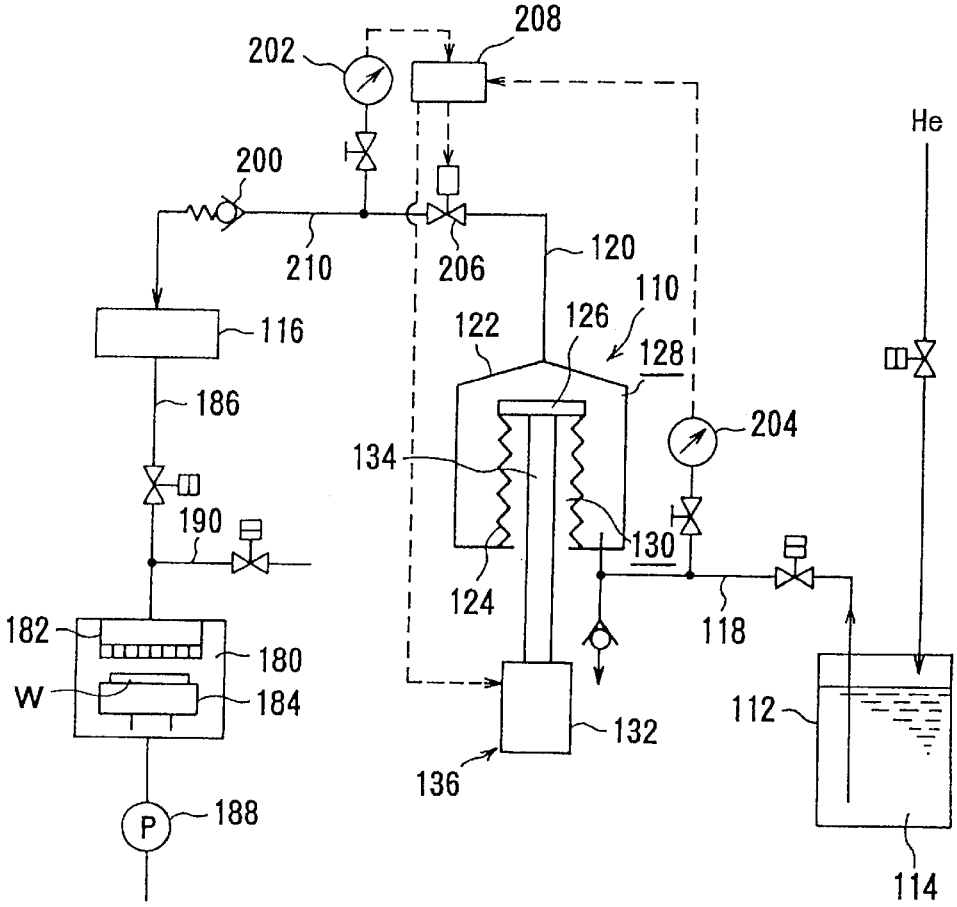
FIG. 10 is a schematic view showing a positive displacement type liquid-delivery apparatus according to a fourth embodiment of the present invention.

FIG. 10 shows a positive displacement type liquid-delivery apparatus according to a fourth embodiment of the present invention. This apparatus includes a positive displacement pump 110 having the same construction as that in the first embodiment, a check valve 200 provided in the outlet pipe 120 that extends from the positive displacement pump 110, and a delivery-liquid pressure sensor 202 for detecting the pressure in the primary side of the check valve 200. The apparatus further includes a liquid-delivery chamber pressure sensor 204 for detecting the pressure in the liquid-delivery chamber 128, a control valve 206 disposed upstream of the check valve 200, and a pressure control unit 208 that receives signals from the delivery-liquid pressure sensor 202 and the liquid-delivery chamber pressure sensor 204 and controls the control valve 206 and the drive unit 132 based on these signals. Therefore, the positive displacement type liquid-delivery apparatus of the present embodiment individually controls the pressure in the primary side of the check valve 200 and the pressure in the liquid-delivery chamber 128.

During a stoppage of delivery liquid with the positive displacement type liquid-delivery apparatus of the present embodiment, the pressure in the primary side of the check valve 200 (i.e., the pressure of liquid contained in a pipe 210 connecting the check valve 200 and the control valve 206) is controlled to be less than the cracking pressure of the check valve 200, and also controlled to be higher than the vapor pressure of the liquid. Also, the pressure in the liquid-delivery chamber 128 is controlled to be at the pressure required for normal pumping operations (hereinafter referred to as operating pressure).

At this time, the pressure in the primary side of the check valve 200 is approximately 1.5 kg/cm$^2$ (≈147 kPa) when, for example, the cracking pressure is 2 kg/cm$^2$ (≈196 kPa) and the vapor pressure of the liquid therein is 0.5 kg/cm$^2$ (≈49 kPa). In addition, the pressure in the liquid-delivery chamber 128 is approximately 2.5 kg/cm$^2$ (≈245 kPa), for example, which is the same as the operating pressure.

Even if the pressure in the primary side of the check valve 200 drops due to a leak in the check valve 200, this pressure is controlled so as to be prevented from dropping below the vapor pressure of the liquid. This method includes the step of driving the drive unit 132 to lower the pressure in the liquid-delivery chamber 128 to the initial pressure in the primary side of the check valve 200, which is 1.5 kg/cm$^2$≈147 kPa) in one example (step 1), and the step of opening the control valve 206 (step 2). Next, the drive unit 132 is driven to set the pressure in the primary side of the check valve 200 to be equivalent to its initial pressure (step 3), and the control valve 206 is closed (step 4). Subsequently, the drive unit 132 is driven to raise the pressure in the liquid-delivery chamber 128 to its initial pressure of 2.5 kg/cm$^2$ (≈245 kPa) (step 5).

If a pump drive signal is received during this operation, the entire system is put on standby until the operation is completed. After completion of this operation, the pump can be driven to control the entire system. This procedure will not cause a delay in the process since it only takes 10–15 seconds to complete.

Lowering the pressure in the primary side of the check valve 200 greatly decreases leaking of the check valve 200. Moreover, by preventing the pressure from dropping below the vapor pressure of the liquid, it is possible to eliminate the generation of voids in the pipe 210. It is also possible to prevent such a condition that a predetermined flow rate of fluid cannot be discharged until the voids disappear and the pressure of liquid exceeds, at least, the cracking pressure of the check valve 200.

It is desirable to set the pressure in the liquid-delivery chamber 128 to the same pressure in the primary side of the check valve 200 in order to prevent leaking in the check valve 200. However, it takes a considerable amount of time after starting the pump to raise the pressure in the liquid delivery chamber 128 high enough to meet the required flow rate. Therefore, by setting the pressure in the liquid-delivery chamber 128 to be equivalent to that of the operating pressure, it is possible to discharge the required flow of fluid immediately after the pumping operation begins, without time lag.

Figure 11:
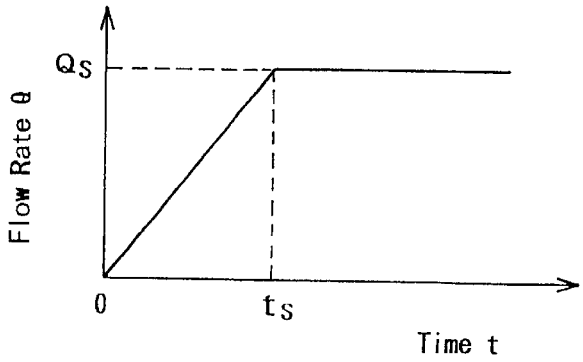
FIG. 11 is a graph showing the relationship between a flow rate and time at the beginning of the pumping process in the apparatus of FIG. 10.

Specifically, by delivering liquid under a constant pressure at all times immediately after the pumping operation begins, as shown in FIG. 11, the flow rate of liquid is allowed to be proportional to time when the flow rate is increasing, whereby a set time $t_8$ for the flow rate to reach a set flow rate $Q_2$ is established and the flow rate can be strictly controlled in the set time $t_2$.

In this example, the pipe 210 connecting the check valve 200 and the control valve 206 is sufficiently short and constructed of a highly rigid material so that there is almost no volume expansion in the pipe 210 even when the pressure therein rises to the same pressure as that in the liquid-delivery chamber 128. Therefore, the pressure in the secondary side of the check valve 200 can be maintained at the operating pressure in order to achieve the required flow rate immediately after the pumping operation begins. However, if a flexible tube or the like is used for the pipe 210, volume expansion may occur in the pipe 210 when the pressure therein rises to the same pressure as that in the liquid-delivery chamber 128. In this case, the pressure in the secondary side of the check valve 200 can be set to the operating pressure immediately after the pumping operation begins by setting the pressure in the liquid-delivery chamber 128 to the pressure (P+α), slightly higher than the pressure P during pumping operations, where the pressure α is equivalent to the estimated amount caused by volume expansion in the pipe 210.

Figure 12:
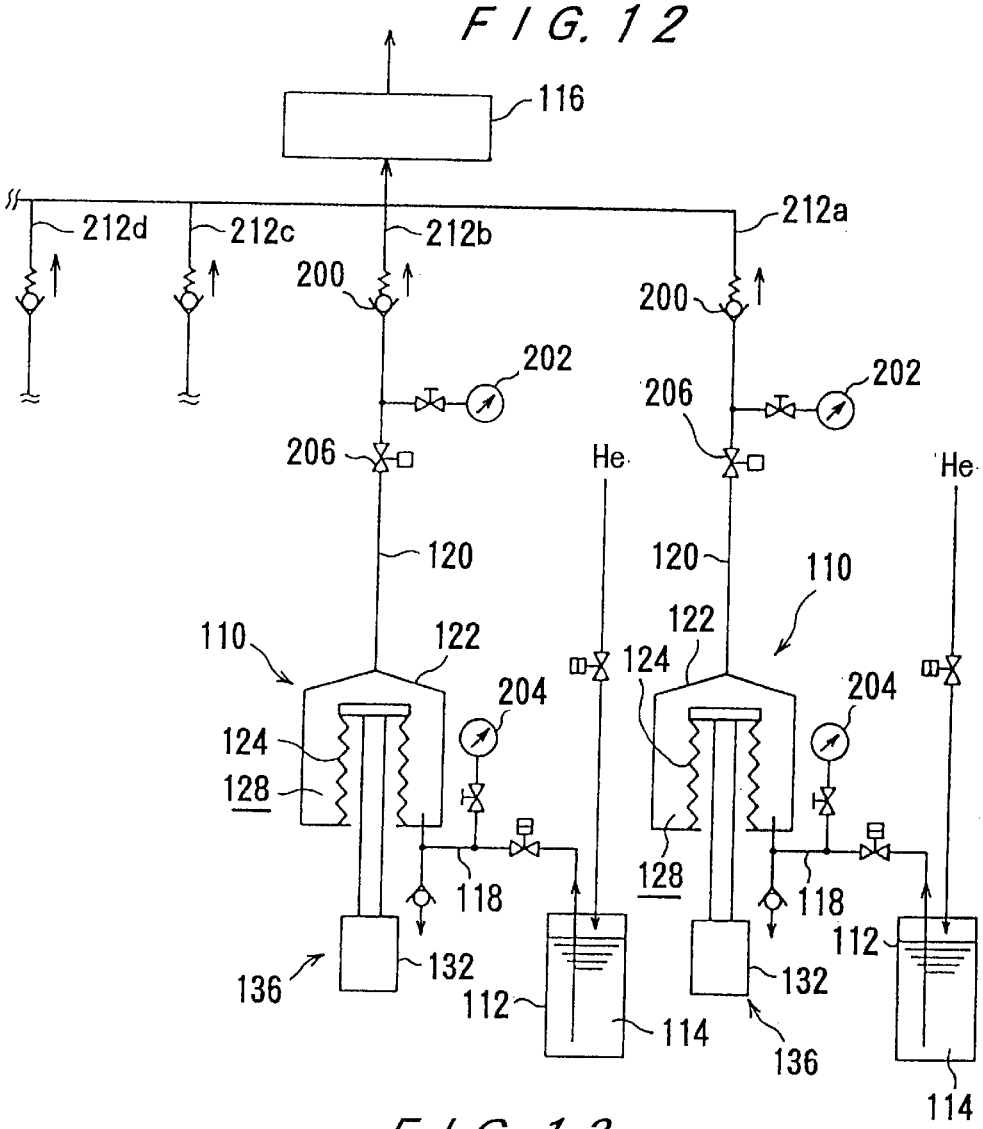
FIG. 12 is a schematic view showing a positive displacement type liquid-delivery apparatus according to a fifth embodiment of the present invention.

FIG. 12 shows a positive displacement liquid-delivery apparatus according to the fifth embodiment of the present invention. This apparatus comprises a plurality of positive displacement pumps 110 with a similar construction as that in the first embodiment. These positive displacement pumps 110 are arranged in parallel and each of the pumps 110 is capable of delivering liquid of a different type simultaneously to the processing apparatus 116. In this example, the positive displacement liquid-delivery apparatus includes a plurality of feed lines 212*a*–212*d*, wherein each feed line is connected to a positive displacement pump 110 for delivery liquid feed A, B, C and D. These feed lines 212*a*–212*d* are joined together in the secondary side of the check valve 200, and then connected to the processing apparatus 116.

Figure 13:
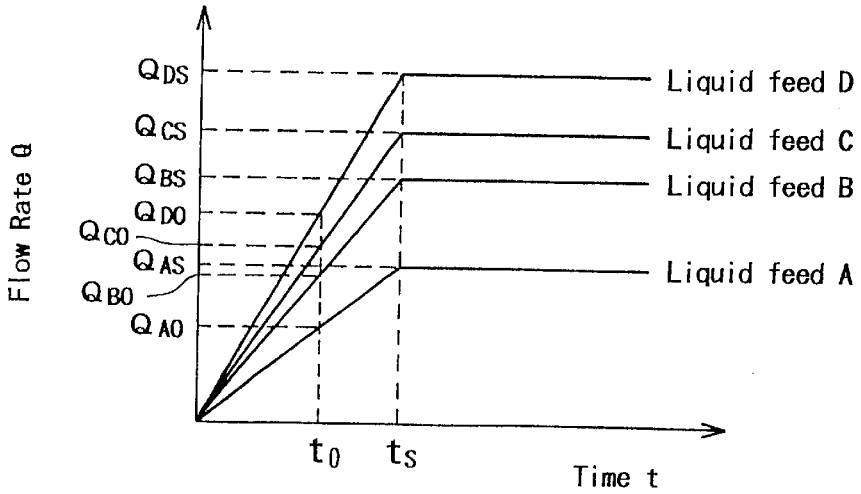
FIG. 13 is a graph showing the relationship between a flow rate and time at the beginning of the pumping process in the apparatus of FIG. 12.

In the present embodiment, the positive displacement liquid-delivery apparatus controls the pressure in the feed lines 212*a*–212*d* in the primary side of the check valve 200 so as not to drop below the vapor pressure of each of the liquid feeds flowing through the respective feed lines 212*a*–212*d*. The apparatus also controls the pressure in the liquid-delivery chamber 128 of each of the positive displacement pumps 110 at the operating pressure or a pressure higher than the operating pressure by an amount α determined by estimating the volume expansion in the pipes. Hence, by setting a constant set time $t_a$ for each of the liquid feeds A, B, C and D to reach a set flow rate $Q_{AS}$, $Q_{DS}$, $Q_{CS}$ and $Q_{D5}$ as shown in FIG. 13, at any arbitrary time $t_0$ within this set time $t_a$, the proportion of flows $Q_{AO}$, $Q_{BO}$, $Q_{CO}$ and $Q_{DO}$ for the liquid feeds A–D is equivalent to the proportion of set flows $Q_{A5}$–$Q_{DS}$ ($Q_{A0}:Q_{B0}:Q_{C0}:Q_{D0}=Q_{AS}:Q_{BS}:Q_{CS}:Q_{DS}$). Hence, it is possible to control the total mixture ratio immediately after the pumping process begins such that the fluid delivered to the processing apparatus 116 always has the same ratio of liquid feeds. This method eliminates such problem that the liquid feeds cannot be used until the pumping operation is stabilized.

Figure 14:
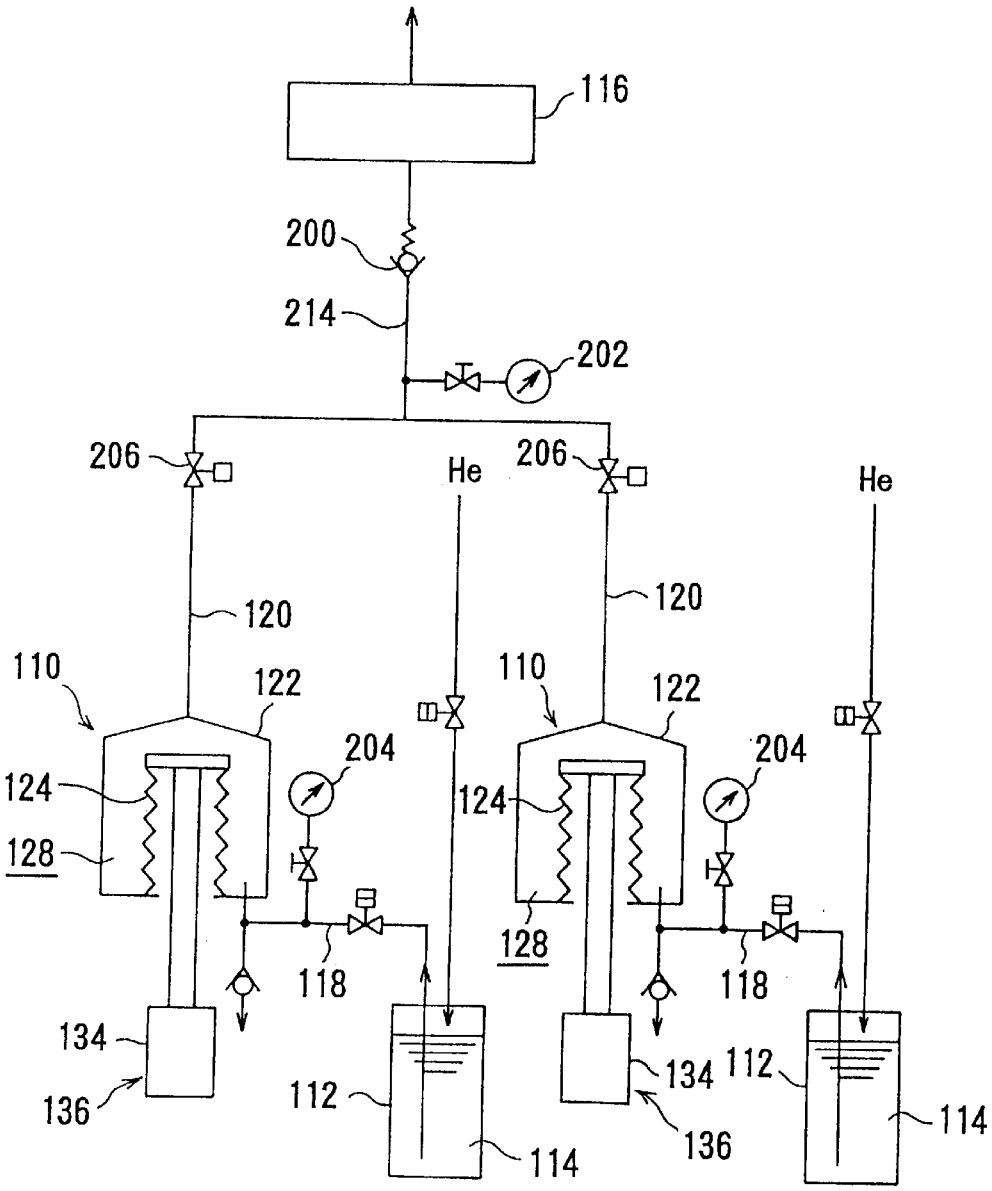
FIG. 14 is a schematic view showing a positive displacement type liquid-delivery apparatus according to a sixth embodiment of the present invention.

FIG. 14 shows a positive displacement liquid-delivery apparatus according to a sixth embodiment of the present invention. This apparatus comprises two positive displacement pumps 110 with a similar construction as that in the first embodiment. The two positive displacement pumps 110 are arranged in parallel and driven to alternately pump the same type of liquid to the processing apparatus 116. In other words, the outlet pipes 120 extending from the respective positive displacement pumps 110 and having respective control valves 206 join together in the primary side of the check valve 200, and the secondary side of the check valve 200 is connected to the processing apparatus 116.

Figure 15:
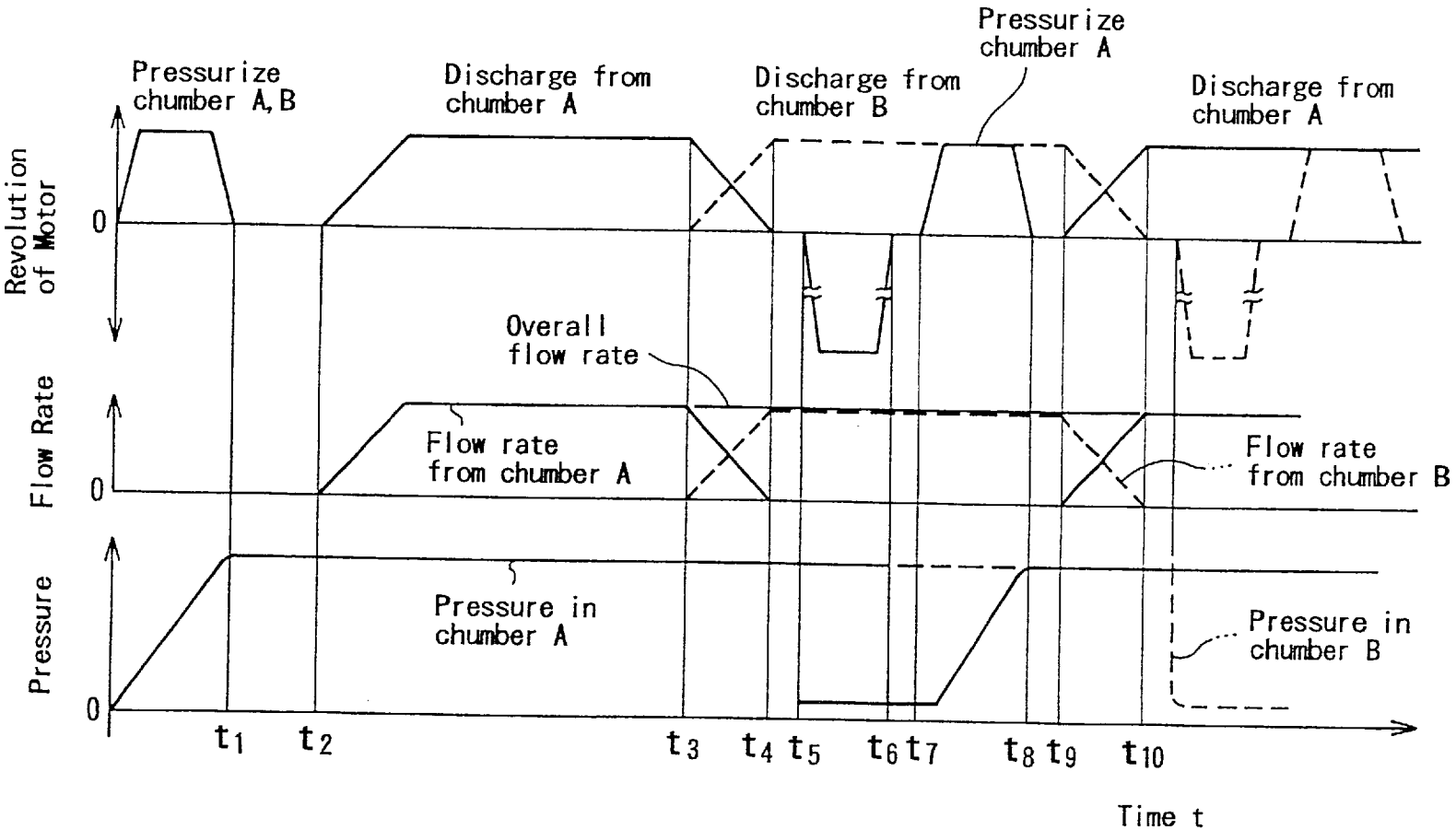
FIG. 15 is a time chart for a control process performed by the positive displacement type liquid-delivery apparatus of FIG. 14.

An example of control conducted by the apparatus of the sixth embodiment will be described with reference to FIG. 15. For purposes of explanation, the liquid-delivery chamber 128 and the control valve 206 positioned on the right side of FIG. 14 will be referred to as liquid-delivery chamber A and control valve A, respectively, while those positioned on the left side of the diagram will be referred to as liquid-delivery chamber B and control valve B, respectively.

While control valves A and B are both closed, the drive unit 132 of each of the positive displacement pumps 110 is driven to bring the pressure in the chambers A and B to the operating pressure (time 0-$t_1$). Based on a pump start signal, the control valve A is opened to discharge liquid from the liquid-delivery chamber A (time $t_2$) After a predetermined interval elapses, the discharge flow rate from the liquid-delivery chamber A is gradually decreased, while at the same time the control valve B is opened to allow liquid to be discharged from the liquid-delivery chamber B. when the flow rate of liquid discharged from the liquid-delivery chamber B reaches a set flow rate, the control valve A is closed (time $t_3$–$t_4$). During this time, the flow rate from the pump that began pumping operation is gradually increased, while the flow rate from the pump that is stopping pumping operation is gradually decreased at the same rate such that the overall flow rate does not change. By alternating operations between two pumps, the same amount of feed fluid can be delivered continuously to the processing apparatus 116 without variation in the flow rate.

After the liquid-delivery chamber A is aspirated (time $t_5$–$t_6$), the liquid-delivery chamber A is pressurized to raise its pressure back to the operating pressure (time $t_7$–$t_8$). After a predetermined interval has elapsed, the discharge flow rate of liquid discharged from the liquid-delivery chamber B is gradually decreased, while simultaneously the control valve A is opened to begin discharging of liquid from the liquid-delivery chamber A. When the discharge flow rate of liquid reaches a set flow rate, the control valve B is closed (time $t_9$–$t_{10}$) and this procedure is repeated.

As described above, the flow rate from the positive displacement pump 110 that starts pumping operation is gradually increased, while the flow rate from the pump that is stopping pumping operation is gradually decreased at the same rate such that the overall flow rate does not change. By alternating operations between two pump, the same amount of feed fluid can be delivered continuously to the processing apparatus 116 without variation in flow.

In this example, a pipe 214 connecting the check valve 200 and control valve 206 is sufficiently short and constructed of a highly rigid material so that there is almost no volume expansion in the pipe 214 when the pressure therein rises to the same pressure as that in the liquid-delivery chamber 128. Therefore, the pressure in the secondary side of the check valve 200 can be maintained at the operating pressure in order to achieve the required flow rate immediately after pumping operation begins. However, if a flexible tube or the like is used for the pipe 214, volume expansion may occur in the pipe 214 when the pressure therein rises to the same pressure as that in the liquid-delivery chamber 128. In this case, the pressure in the secondary side of the check valve 200 can be raised to the operating pressure immediately after pumping operation begins by setting the pressure in the liquid-delivery chamber 128 to the pressure (P+α), slightly higher than the pressure P during pumping operations, where the pressure α is equivalent to the estimated amount caused by volume expansion in the pipe 214.

As described above, according to the present invention, in a positive displacement liquid-delivery system employing a flexible diaphragm that is driven externally by a drive mechanism, the differential pressure between the inner and outer sides of the diaphragm is controlled at a constant value while the diaphragm is displaced. Hence, it is possible to provide a compact apparatus capable of delivering liquid with great precision. This type of apparatus is very useful in manufacturing processes for semiconductor elements.

Further, the pressure in the primary side of the check valve is controlled so as not to fall below the vapor pressure of the liquid therein when the pumping operations are stopped. Furthermore, the pressure in the liquid-delivery chamber is maintained at the operating pressure or at a higher pressure. Accordingly, the time required to stabilize pumping operations can be shortened, and it is possible to control the flow rate of liquid immediately after pumping operations begin.

Although certain preferred embodiments of the present invention have been shown and described in detail, it should be understood that various changes and modifications may be made therein without departing from the scope of the appended claims.

What is claimed is:

1. A positive displacement liquid-delivery apparatus comprising:

a positive displacement pump including a housing having a liquid-delivery chamber and a working space divided from said liquid-delivery chamber by a flexible diaphragm, and including a diaphragm driving unit linked to said diaphragm to discharge fluid from said liquid-delivery chamber by changing a volume of said liquid-delivery chamber; and a differential pressure control unit for controlling a differential pressure between said liquid-delivery chamber and said working space so as to maintain the differential pressure between said liquid-delivery chamber and said working space at a constant value during a pumping operation of said positive displacement pump;

wherein said diaphragm driving unit is operable to change the volume of said liquid-delivery chamber while said differential pressure control unit maintains the differential pressure between said liquid-delivery chamber and said working space at the constant value.

2. A positive displacement liquid-delivery apparatus as claimed in claim 1, wherein the differential pressure control unit comprises:

a differential pressure sensor for detecting the differential pressure between said liquid-delivery chamber and said working space, and for generating a differential pressure signal based on the detected differential pressure; and a control valve for controlling a flow rate of the fluid discharged from said liquid-delivery chamber based on the differential pressure signal generated by said differential pressure sensor.

3. A positive displacement liquid-delivery apparatus as claimed in claim 2, further comprising:

a flow sensor disposed on a discharge path from said positive displacement pump and operable to detect the flow rate of the fluid discharged from said liquid-delivery chamber, and to generate a flow signal based on the detected flow rate;

wherein said control valve is operable to control the flow rate of the fluid discharged from said liquid-delivery chamber based on the flow signal generated by said flow sensor when a pressure in said liquid-delivery chamber during the pumping operation exceeds a prescribed pressure value or when an absolute value of a rate of pressure variations exceeds a prescribed pressure variation value.

4. A positive displacement liquid-delivery apparatus as claimed in claim 1, wherein said liquid-delivery chamber is arranged so as to achieve a required discharge flow volume of the fluid in one stroke.

5. A positive displacement liquid-delivery apparatus as claimed in claim 1, further comprising a flow control unit including:

a flow sensor disposed on a discharge path from said positive displacement pump and operable to detect the flow rate of the fluid discharged from said liquid-delivery chamber, and to generate a flow signal based on the detected flow rate; and a control valve for controlling a flow rate of the fluid discharged from said liquid-delivery chamber based on the flow signal generated by said flow sensor.

6. A positive displacement liquid-delivery apparatus as claimed in claim 1, wherein said diaphragm driving unit of said positive displacement pump comprises:

a drive unit; and a rod having a first end linked to said drive unit such that said drive unit is operable to move said rod along a longitudinal axis of said rod in either direction, and having a second end linked to said diaphragm so as to move said diaphragm.

7. A deposition apparatus comprising:

a positive displacement liquid-delivery apparatus comprising:

a positive displacement pump including a housing having a liquid-delivery chamber and a working space divided from said liquid-delivery chamber by a flexible diaphragm, and including a diaphragm driving unit linked to said diaphragm to discharge fluid from said liquid-delivery chamber by changing a volume of said liquid-delivery chamber; and a differential pressure control unit for controlling a differential pressure between said liquid-delivery chamber and said working space so as to maintain the differential pressure between said liquid-delivery chamber and said working space at a constant value during a pumping operation of said positive displacement pump;

a vaporizer for vaporizing the fluid discharged from said positive displacement liquid-delivery apparatus; and a deposition chamber in which thin films are deposited using the feed gas supplied from said vaporizer;

wherein said diaphragm driving unit of said positive displacement liquid-delivery apparatus is operable to change the volume of said liquid-delivery chamber while said differential pressure control unit maintains the differential pressure between said liquid-delivery chamber and said working space at the constant value.

8. A deposition apparatus as claimed in claim 7, wherein the differential pressure control unit comprises:

a differential pressure sensor for detecting the differential pressure between said liquid-delivery chamber and said working space, and for generating a differential pressure signal based on the detected differential pressure; and a control valve for controlling a flow rate of the fluid discharged from said liquid-delivery chamber based on the differential pressure signal generated by said differential pressure sensor.

9. A deposition apparatus as claimed in claim 8, wherein said positive displacement liquid-delivery apparatus further comprises:

a flow sensor disposed on a discharge path from said positive displacement pump and operable to detect the flow rate of the fluid discharged from said liquid-delivery chamber, and to generate a flow signal based on the detected flow rate;

wherein said control valve is operable to control the flow rate of the fluid discharged from said liquid-delivery chamber based on the flow signal generated by said flow sensor when a pressure in said liquid-delivery chamber during the pumping operation exceeds a prescribed pressure value or when an absolute value of a rate of pressure variations exceeds a prescribed pressure variation value.

10. A deposition apparatus as claimed in claim 7, wherein said liquid-delivery chamber is arranged so as to achieve a required discharge flow volume of the fluid in one stroke.

11. A deposition apparatus as claimed in claim 7, wherein said positive displacement liquid-delivery apparatus further comprises a flow control unit including:

a flow sensor disposed on a discharge path from said positive displacement pump and operable to detect the flow rate of the fluid discharged from said liquid-delivery chamber, and to generate a flow signal based on the detected flow rate; and a control valve for controlling a flow rate of the fluid discharged from said liquid-delivery chamber based on the flow signal generated by said flow sensor.

12. A deposition apparatus as claimed in claim 8, wherein said diaphragm driving unit of said positive displacement pump comprises:

a drive unit; and a rod having a first end linked to said drive unit such that said drive unit is operable to move said rod along a longitudinal axis of said rod in either direction, and having a second end linked to said diaphragm so as to move said diaphragm.

* * * * *